US005977467A

United States Patent [19]

Freeland et al.

[11] Patent Number: 5,977,467

[45] Date of Patent: Nov. 2, 1999

[54] FREQUENCY DISPLAY FOR AN AUTOMATICALLY TUNED STRINGED INSTRUMENT

[75] Inventors: Stephen J. Freeland; Neil C. Skinn, both of Fort Collins, Colo.

[73] Assignee: TransPerformance, LLC, Littleton, Colo.

[ * ] Notice: This patent issued on a continued prosecution application filed under 37 CFR 1.53(d), and is subject to the twenty year patent term provisions of 35 U.S.C. 154(a)(2).

[21] Appl. No.: 08/680,725

[22] Filed: Jul. 12, 1996

Related U.S. Application Data

[60] Provisional application No. 60/001,204, Jul. 14, 1995.

[51] Int. Cl.[6] ..... G10G 7/02

[52] U.S. Cl. ..... 84/454; 84/297 S; 84/477 R; 84/DIG. 18

[58] Field of Search ..... 84/454, 297 R, 84/298, 297 S, 307, 477 R, DIG. 18

[56] References Cited

U.S. PATENT DOCUMENTS

| | | | |
|---|---|---|---|
| 3,144,802 | 8/1964 | Faber, Jr. et al. | 84/454 |
| 4,044,239 | 8/1977 | Shimauchi et al. | 235/151.3 |
| 4,088,052 | 5/1978 | Hedrick | 84/454 |
| 4,196,652 | 4/1980 | Raskin | 84/453 |
| 4,204,453 | 5/1980 | Gross | 84/1.24 |
| 4,207,791 | 6/1980 | Murakami | 84/1.01 |
| 4,313,361 | 2/1982 | Deutsch | 84/1.01 |
| 4,327,623 | 5/1982 | Mochida et al. | 84/454 |
| 4,375,180 | 3/1983 | Scholz | 84/454 |
| 4,392,409 | 7/1983 | Coad, Jr. et al. | 84/462 |
| 4,426,907 | 1/1984 | Scholz | 84/454 |
| 4,434,697 | 3/1984 | Roses | 84/454 |
| 4,479,416 | 10/1984 | Clague | 84/462 |
| 4,584,923 | 4/1986 | Minnick | 84/454 |
| 4,688,464 | 8/1987 | Gibson et al. | 84/454 |
| 4,690,026 | 9/1987 | McCoy | 84/1.19 |
| 4,732,071 | 3/1988 | Deutsch | 84/454 |
| 4,803,908 | 2/1989 | Skinn et al. | 84/454 |
| 4,909,126 | 3/1990 | Skinn et al. | 84/454 |
| 4,958,550 | 9/1990 | Kugimoto | 84/454 |
| 5,009,142 | 4/1991 | Kurtz | 84/454 |
| 5,038,657 | 8/1991 | Busley | 84/455 |
| 5,056,398 | 10/1991 | Adamson | 84/454 |
| 5,095,797 | 3/1992 | Zacaroli | 84/455 |
| 5,323,680 | 6/1994 | Miller et al. | 84/455 |
| 5,343,793 | 9/1994 | Pattie | 84/454 |
| 5,388,496 | 2/1995 | Miller et al. | 84/454 |

FOREIGN PATENT DOCUMENTS

| | | |
|---|---|---|
| 59-136787 | 8/1984 | Japan . |
| 2049226 | 12/1980 | United Kingdom . |

*Primary Examiner*—William M. Shoop, Jr.
*Assistant Examiner*—Marlon T. Fletcher
*Attorney, Agent, or Firm*—Greenlee, Winner and Sullivan, PC

[57] ABSTRACT

This invention is a display system for an automatically tuned stringed instrument displaying, individually or simultaneously, the frequency of each string of the instrument. The system provides for using the display to manually tune the instrument or to initially tune the instrument to within the operating range of the automatic tuning system.

29 Claims, 5 Drawing Sheets

FREQUENCY DISPLAY FOR AN AUTOMATICALLY TUNED STRINGED INSTRUMENT

This application is based on Provisional Application No. 60/001,204, filed Jul. 14, 1995, which in incorporated herein by reference in its entirety.

FIELD OF THE INVENTION

This invention relates to a system for displaying the frequencies produced by an automatically tuned stringed instrument.

BACKGROUND OF THE INVENTION

Manually tuning a musical instrument can be a difficult and tedious process, usually requiring a considerable amount of time and skill. Frequently, a musician will need to verify or change the tuning of an instrument during a performance but, because of the time required, manually retuning the instrument is usually unacceptable. One common, although expensive and inconvenient, solution to this problem is to have properly tuned spare instruments available for such occasions. A much better solution is to have a system for tuning an instrument within a length of time short enough to be acceptable by an audience.

To satisfy this need, there are many different kinds of automatic tuning systems, which can be built into a stringed instrument. Such systems provide ease and convenience as well as accuracy in tuning an instrument, especially in front of an audience. However, these systems do not provide a musician with the capability of easily determining if the instrument is in tune without retuning. Also, these automatic systems are often only able to fine tune an instrument; that is, the instrument must be roughly tuned to within the operating range of the automatic system before the system will work.

Many different types of automatic tuning systems have been devised. There are open-loop systems which drive a tuning actuator to a predetermined position for each desired frequency. These have the advantage of being able to change tuning silently, and therefore unnoticed, during a performance. There are closed-loop systems which measure the frequency of the tone produced by the instrument, compare it to a desired value, and use the result of the comparison to control an actuator which tunes the instrument. This technique is accurate in that it directly controls the frequency of the instrument and is independent of other factors which affect frequency. However, it has the disadvantage that an audible tone must be produced while the instrument is being tuned and the audible tone may preclude tuning during a performance. Some tuning systems, because of interactions between strings, sequentially tune each string and then iterate to compensate for the interactions. Others tune selected strings, or all strings, simultaneously and then iterate. Still other systems measure the tension of (actually, the force applied to) a string and compare the measured value with a desired value to produce an actuator control signal.

A system which compensates for the effect of adjusting one string on the frequencies of the remaining strings, described in U.S. Pat. Nos. 4,803,908 and 4,909,126 to Skinn et al., both of which are herein incorporated by reference in their entirety, involves the use of a calibration function which relates the position of each actuator to the frequencies produced by all the instrument's strings. Creating the calibration function involves the measurement of frequencies at multiple positions of each actuator and, through regression techniques, relating the position of each actuator to not only the frequency of its own string but to the frequencies of the other strings as well. The use of regression techniques provides the advantage that a prior knowledge of the detailed characteristics of the instrument being tuned is not required. Also, the calibration function can be updated by recalibration as the instrument ages, or as environmental or other changes occur. Using a calibration function generated from the particular instrument being tuned permits open-loop, and therefore silent, tuning with accuracy comparable to that of closed-loop systems.

Automatic tuning systems usually have a transducer for generating an electrical signal representing the sound produced by the strings and a processor for obtaining the frequency of that signal. However, none of the previously described systems provides a display of all the frequencies simultaneously which can be used for manually tuning the instrument. If, for example, a string breaks and is replaced, or a new set of strings is installed, it is necessary even with an automatic tuning system to manually tune the instrument to a point within the operating range of the automatic system. Manually tuning an instrument under these conditions usually requires for reference a tone generator or another musical instrument, or else some kind of frequency measuring device. All of these tone references only reveal information about one string at a time. However, because the tensions in the individual strings interact, manually tuning a stringed instrument is much easier if the effects on all strings are evident at the same time.

There are many different types of devices, frequently called tuners, available for providing frequency information to the person tuning an instrument. One type of tuner has a microphone for detecting the audible tone produced by the string of an instrument and a meter or digital display for displaying the frequency of the tone to the person tuning the instrument. Another type of tuner is a tone generator for producing an audible reference tone to which a person can compare the frequency of a string of the instrument being tuned. Tone generators range from simple tuning forks to electronic devices producing a wide range of selectable frequencies. However, all these devices provide information about only one frequency at a time and typically are not a part of the instrument being tuned.

It is therefore an object of this invention to provide a display, indicating the frequencies of all the strings on an instrument either individually or simultaneously, which is available when a musician is playing or manually tuning the instrument. A further object of the invention is to enable a musician to quickly evaluate the tuning of an instrument and to tune the instrument manually to within the working range of the automatic tuning system.

SUMMARY OF THE INVENTION

The invention is a display system for an automatically tuned stringed musical instrument, for simultaneously displaying the frequency of vibration of multiple strings. The display can be used when an operator is playing or manually tuning the instrument.

The display system, coupled to a transducer, determines the vibrating frequency of each string and displays the frequencies either individually or simultaneously. The system enables an operator both to quickly determine the tuning of the instrument and to quickly and easily tune the instrument manually even if it is far out of tune.

By displaying all frequencies simultaneously, the display system enables an operator to immediately see with a single strum the tuning of every string on the instrument. The operator can then determine the magnitude and direction of adjustment needed for each string and make a first approximation to correcting the tuning of all the strings from the frequency information provided by the single strum. By seeing the entire tuning situation at once, the number of strums required to tune the instrument can be minimized. The simultaneous display also enables the operator to see at a glance if the instrument needs tuning and to make an estimate of the time required to tune if necessary. If before an audience and the instrument is found to be out of tune, the operator can then decide to tell a story of appropriate length while tuning the instrument, or to switch instruments, or to take some other action.

If only one string is plucked, the system displays, or updates the display of, the frequency for that one string. The same is true for two or more strings; each string has its own frequency display. This permits the operator to concentrate on tuning one string if that is preferred. This is particularly useful when a string is being replaced, for example.

As long as a string is vibrating with sufficient amplitude, the system can continually update that string's frequency display using a sample and hold process. When the amplitude becomes insufficient, the system can hold the frequency display of the last sufficient amplitude and provide some indication that the display is not in real time.

The features just described are available for use when manually tuning an instrument. They permit an operator to simultaneously observe not only the effect on the frequency of the string being adjusted but the effects on the frequencies of the other strings as well. This capability is particularly useful for manually adjusting the tension of each string to its preferred value within the operating range of an automatic tuning system. For example, in a closed loop system, it may be necessary or desirable to manually adjust a string to a tension such that the center of the actuator range is also the center of the desired frequency range. When used with a system having a calibration function, such as described in copending U.S. patent application Ser. No. 08/679,080 entitled "Musical Instrument Self-Tuning System with Calibration Library" (attorney docket number 63-94) filed concurrently herewith, and herein incorporated by reference in its entirety, it is necessary to manually tune a string to a frequency within the domain of its calibration function where the function is valid. Preferably each string should be manually tuned to within 20 cents of the target frequency and ideally within two cents of the target frequency.

An advantage of this display system is that it does not add much complexity because an automatically tuned instrument usually requires for its own function a transducer and a processor for obtaining the frequency from the transducer signal.

In the preferred embodiment, to compensate for string interactions, the system uses a calibration function as described in the aforementioned copending application (attorney docket no. 63-94). This calibration function generates each actuator position in response to the entire set (one per string) of desired, or target, frequencies comprising a desired tuning configuration.

BRIEF DESCRIPTION OF THE DRAWING

The above-mentioned and other features and objects of the invention and the manner of attaining them will become more apparent and the invention itself will best be understood by reference to the following description of embodiments of the invention taken in conjunction with the accompanying drawing, a brief description of which follows.

DESCRIPTION OF THE PREFERRED EMBODIMENT

Figure 1:
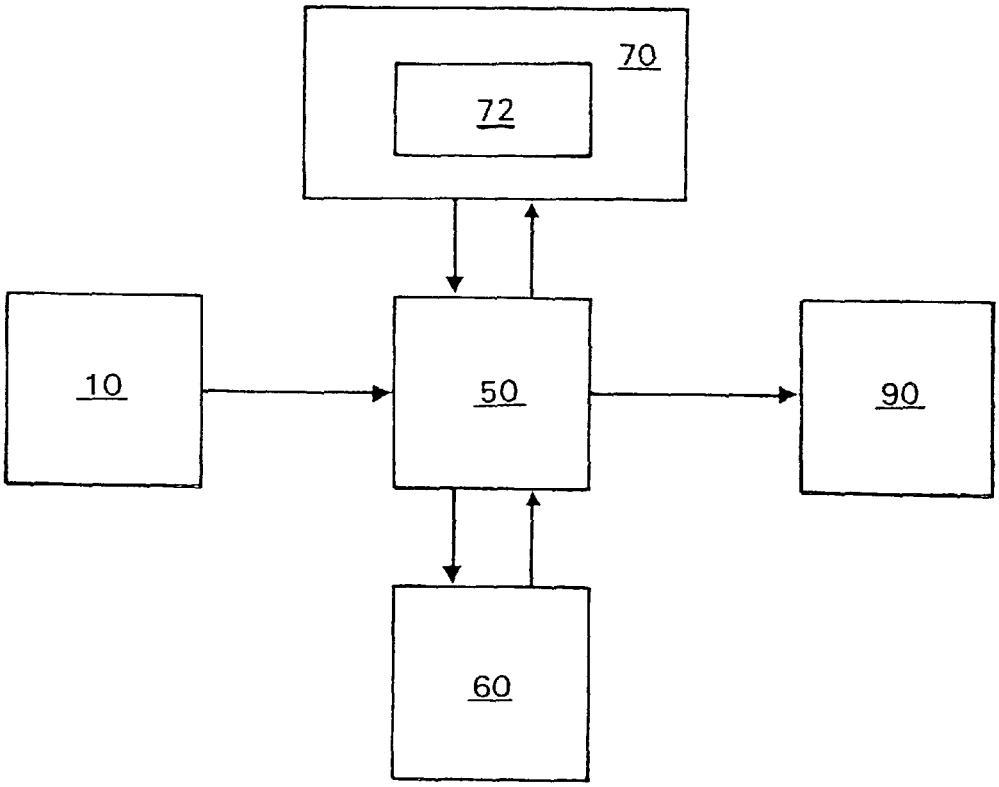
FIG. 1 is a block diagram of an automatic tuning system utilizing this invention.

When reference is made to the drawing, like numerals will indicate like parts and structural features in the various figures. Also, hereinafter, the following definitions apply:

- actuator: a device for changing a frequency of the instrument in response to a control signal;
- actuator position: a particular actuator output affecting frequency, such as angle, force, pressure or linear position;
- actuator operating range: the range of actuator positions over which an automatic tuning system can operate, as defined by physical or logical limit stops or by the domain, range, or accuracy limits of a controlling function;
- calibration function: any function relating frequency and actuator position and may be represented by, and stored as, a set of coefficients for a specific mathematical expression or as values in a look-up table;
- simultaneous display: a display of multiple images which appear to the human eye to be presented concurrently although they may actually be presented sequentially at a speed exceeding the eye's response;
- real time: a time sufficiently close to the occurrence of an event as to be indistinguishable by a human observer from the actual time of the occurrence;
- target frequency: a desired frequency to which a string is to be tuned;
- tuning configuration: a group of target frequencies (one per string) which comprise a particular target tuning of an instrument;
- cents: a measure of frequency in which 100 cents equal one half-step; i.e., 1200 cents equal one octave;
- frequency indicators: numbers and symbols representing either absolute or relative, or both, values of frequency (for example, a frequency displayed as a note and an offset in cents); and
- wherein the terms frequency and period are regarded as equally unambiguous measures of frequency.

The invention is a display system for an automatically tuned stringed instrument, showing the frequency of vibration of each string on the instrument individually or simultaneously. The preferred embodiment includes a control system which automatically adjusts the instrument to produce a set (one per string) of target frequencies.

A functional block diagram of the frequency display system within an automatic tuning system is shown in FIG. 1. Transducer 10 is coupled to processor 50 which is in turn connected to operator interface 70, including display unit 72, and to actuator 90. Memory 60 is also connected to processor 50. FIG. 1 depicts simplified functional blocks of the system. It should be recognized that the depicted functions do not show details which should be familiar to those with ordinary skill in the art.

Transducer 10 produces an electrical transducer signal representing a sound produced by the instrument (not shown). Processor 50 receives the transducer signal from transducer 10 and utilizes it to generate a display signal which is provided to and used by display unit 72 to display the frequency of the sound produced by each string. Processor 50 also receives input from, and provides output to, the operator via operator interface 70.

When automatically tuning the instrument, processor 50 also generates control signals which are utilized by actuator 90 to tune the instrument. In an automatically tuned instrument, the strings are typically attached to or otherwise coupled with actuator 90 at one end of the string, generally the bridge end, and are attached to a manual tuning mechanism such as a tuning peg at the other end of the string. It is during manual tuning that the frequency display system of this invention is particularly useful.

In a preferred embodiment, the automatic tuning control system is an open loop system which uses a calibration function to generate actuator positions from a set of target frequencies. As described in detail in the aforementioned concurrently filed U.S. patent application (attorney docket no. 63-94), the calibration function predicts target actuator positions for each string as a function of the target frequencies of all of the strings.

An alternative to the open-loop control system is a closed-loop (servo) system. In automatically tuning with this system, the instrument is strummed and the difference between the measured frequency of each string and the target frequency for that string is used to generate an error signal. A control signal is generated from the error signal and is applied to the actuator drive circuits. The actuator then moves to reduce the error signal to zero as in a traditional servo system.

Figure 2:
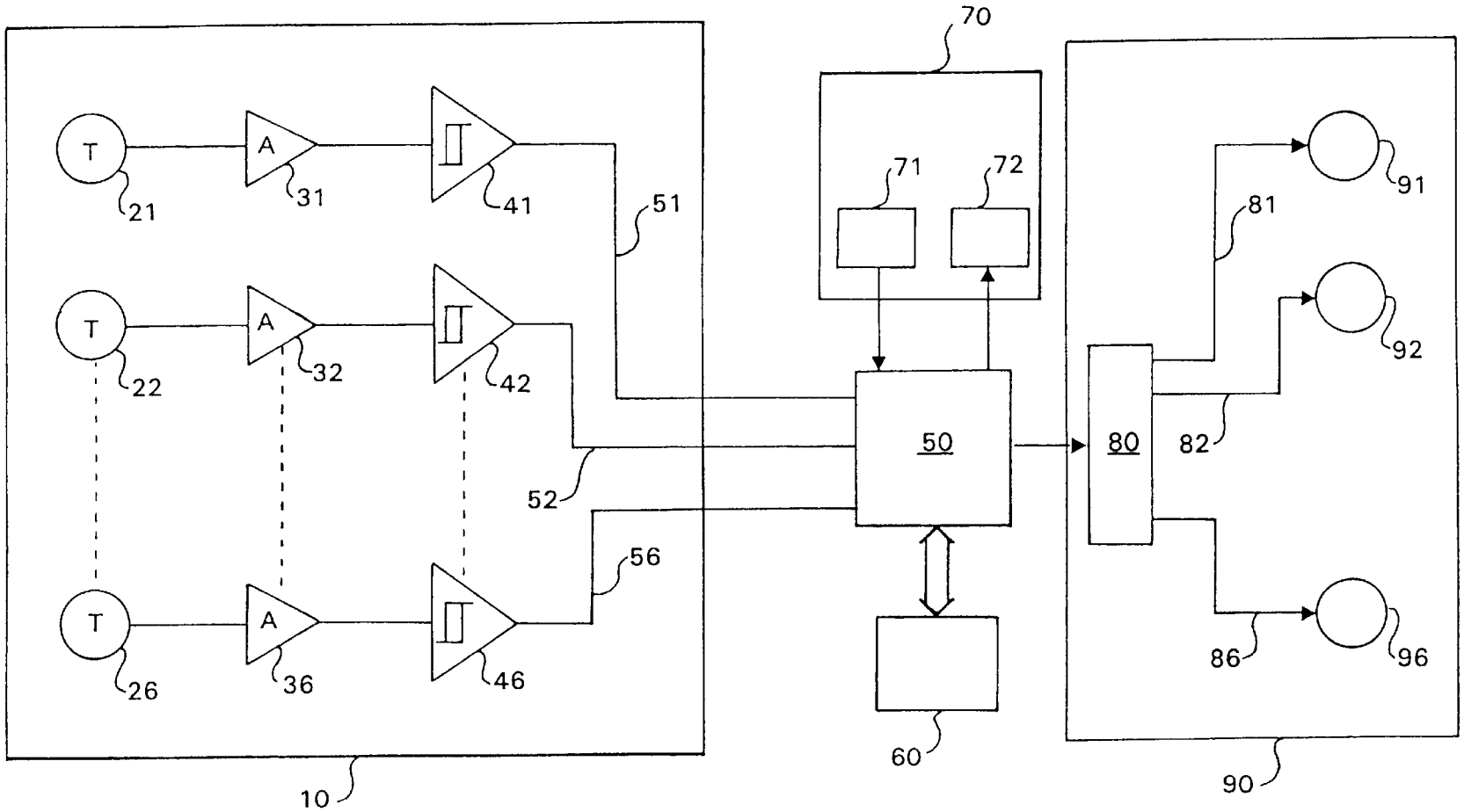
FIG. 2 is a block diagram of a preferred embodiment of an automatic tuning system utilizing this invention.

FIG. 2 is a block diagram of a preferred embodiment used in a stringed instrument. Referring to FIG. 2, transducer 21 is connected through amplifier 31 to Schmitt trigger 41 which is connected to processor 50. In a similar manner, transducers 22–26 are connected through amplifiers 32–36 to Schmitt triggers 42–46 which are also connected to processor 50. Switch panel 71, display unit 72 and memory 60 are also connected to processor 50. Processor 50 is connected to actuator driver circuit 80 which is connected to actuators 91–96.

During display operations or during calibration of the automatic tuning system, when the string associated with transducer 21 is caused to vibrate, for example by strumming, plucking or hammering, a transducer signal having the frequency of the vibrating string is generated by transducer 21 and applied to the input of amplifier 31. Amplifier 31 has a low-pass frequency characteristic with a cutoff frequency chosen to permit amplification of the fundamental frequency of the string while reducing the effect of harmonics. The amplified transducer signal is applied to the input of Schmitt trigger 41 which is configured to produce a binary output signal having the same frequency as the vibrating string. The signal paths for the other strings, transducers 22–26, amplifiers 32–36, and Schmitt triggers 42–46 operate in the same way. The amplifiers and triggers can be part of the processor.

The processor includes means for obtaining the measured frequency from the transducer signal. In this embodiment, processor 50 is a digital computer which utilizes a clock signal and a counter to accurately measure the periods of each of the binary signals supplied by Schmitt triggers 41–46. The period measurements can be performed either concurrently or consecutively and still be perceived as real time since only one period of a few milliseconds in duration is needed for each measurement. Also, since the time required for each measurement is small, the measurements can be replicated for greater precision if necessary. As used herein, the singular term frequency measurement includes as many sampling measurements as necessary to obtain a statistically valid frequency value.

Figure 3:
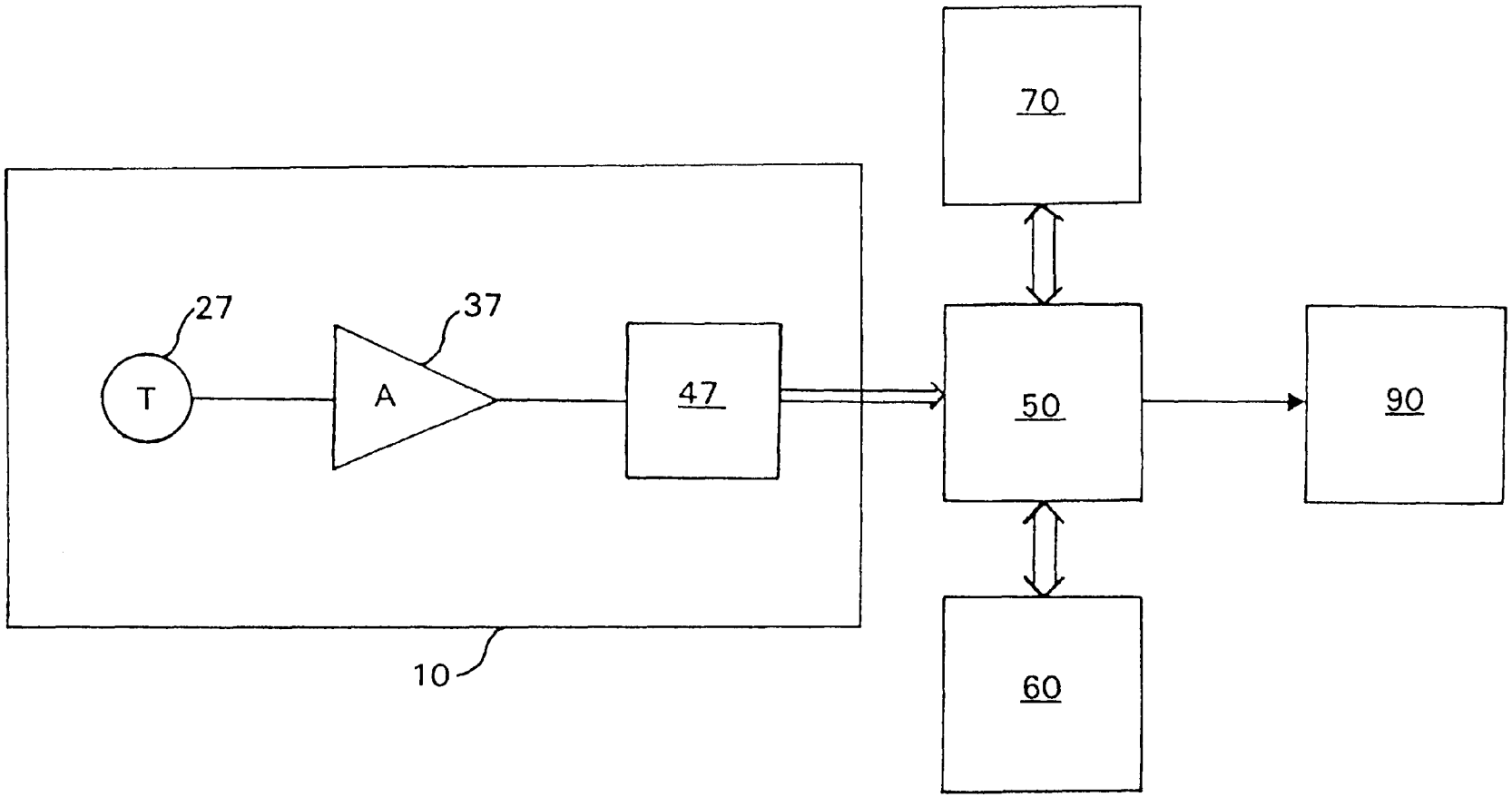
FIG. 3 is a modification of the tuning system of FIG. 2 utilizing a single transducer.

In another embodiment, shown in FIG. 3, transducer 27 is connected to analog-to-digital (ADC) converter 47 through amplifier 37. The output of ADC 47 is connected to processor 50. The single transducer 27 is coupled to all strings in the instrument and provides a single analog electrical transducer signal, representing the combined tones of all the strings, to amplifier 37. The amplified analog transducer signal is digitized by analog-to-digital converter (ADC)47. The amplifier and ADC can be part of the processor. The signal is analyzed by processor 50 using a Fourier transform, or other processing algorithm, to obtain the individual frequency for each of the vibrating strings. As an alternative to using a Fourier transform, depending on the frequency spectrum and the speed and accuracy required, the individual frequencies can be obtained by using banks of bandpass filters implemented in hardware or software and operating concurrently or consecutively. Obtaining frequency information from a single transducer is described in greater detail in concurrently filed U.S. patent application Ser. No. 08/679,057 entitled "Multiple Frequency Display for Musical Sounds" (attorney docket no. 56-95), which is incorporated by reference herein in its entirety. In the present invention the embodiment of FIG. 2, having a separate transducer for each string, is preferred because it allows faster, simpler frequency measurement without needing to separate the tones from a plurality of strings within one transducer signal.

In general, for any transducer configuration, processor 50 generates and provides to display unit 72 display signals for controlling the operation of the display unit. The display signals may be provided serially or in parallel, or both, as necessary to provide simultaneous real time displays of multiple frequencies.

In an automatic update mode, processor 50 repetitively measures the frequency of each signal and refreshes the corresponding display on display unit 72. In a manual update mode, processor 50 provides a single measurement of each frequency to display unit 72 and that display is held until manually updated or cleared. As used herein, the singular term frequency measurement includes as many sampling measurements as necessary to obtain a statistically valid frequency value.

Processor 50 utilizes switch panel 71, non-volatile memory 60, and display unit 72 for other input and output functions. Switch panel 71 provides a way for an operator to enter commands and data for controlling the system. Memory 60 provides storage for instructions and data. Display unit 72 provides for processor 50 to display in addition to frequency various other kinds of information (e.g. status, prompts, or data) to the operator.

Figure 4:
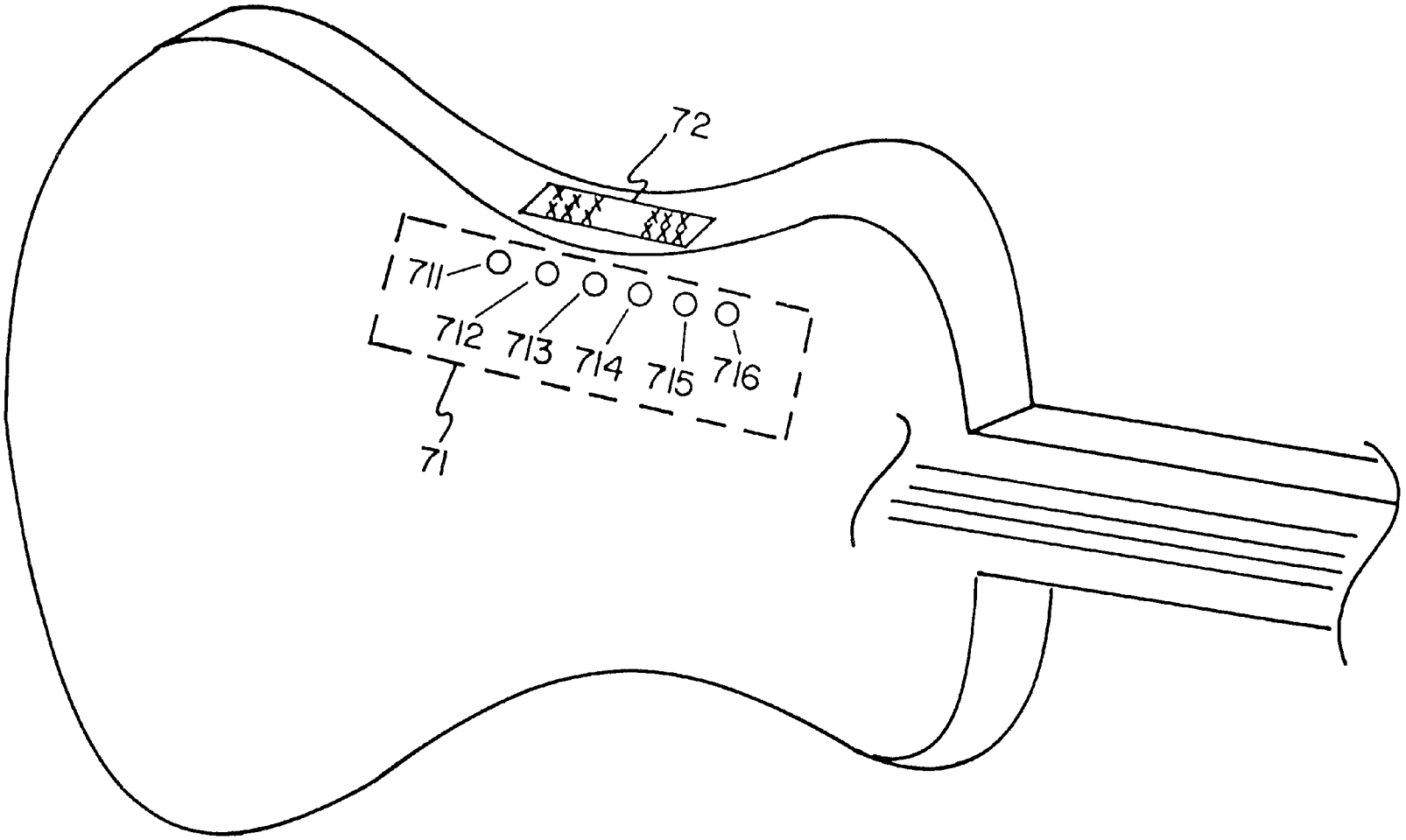
FIG. 4 is a diagram showing more details of the display unit and the control panel used in the system shown in FIGS. 2 and 3.

FIG. 4 shows a preferred embodiment of switch panel 71 and display unit 72 of FIG. 2 in more detail. Some aspects of it are further described in the Digital Tuning System DTS-1 Owner's Manual (1992), TransPerformance Corporation, Fort Collins, Colo., which is incorporated by reference herein in its entirety. Switch panel 71 comprises six push buttons 711–716 located on the front face of the instrument. The six push buttons consist of four arrow buttons, a select (SEL) button, and an END button. Display unit 72 is a liquid crystal display (LCD), having two rows of 24 characters each, located on the top of the instrument where it is easily visible to the operator. In operation the LCD is normally partitioned into a menu containing four regions of 12 characters each, one of which is blinking. In effect, the LCD acts as a four region window into a larger hidden two-dimensional menu area of similar regions. By use of the arrow buttons, the blinking region can be moved within the window, and the window can be moved throughout the area by attempting to move the blinking region beyond a window border. Attempting to move beyond the edge of the area causes the window to wrap around to the opposite side of the area. An item from the menu is selected by moving the blinking region to the item desired and pressing the SEL button. Selecting a menu item may either execute that item or bring up a submenu as appropriate. Pressing the END button returns the display to the previous menu. The combination of switches 711–716 and display unit 72 permits selection of modes, such as PLAY, TOUCH-UP and EDIT, as well as selection and modification of stored calibration functions and stored tuning configurations. For example, the EDIT mode permits the operator to edit stored tuning configurations and to enter new tuning configurations. More or different switches or display panels, or both, may be used to enhance the operator's interaction with the system, as will be recognized by those skilled in the art. A feature of this invention that is not included in the 1992 Manual is the ability to display the frequencies of the strings while manually tuning and to display the frequencies with sufficient accuracy for manual tuning.

Figure 5:
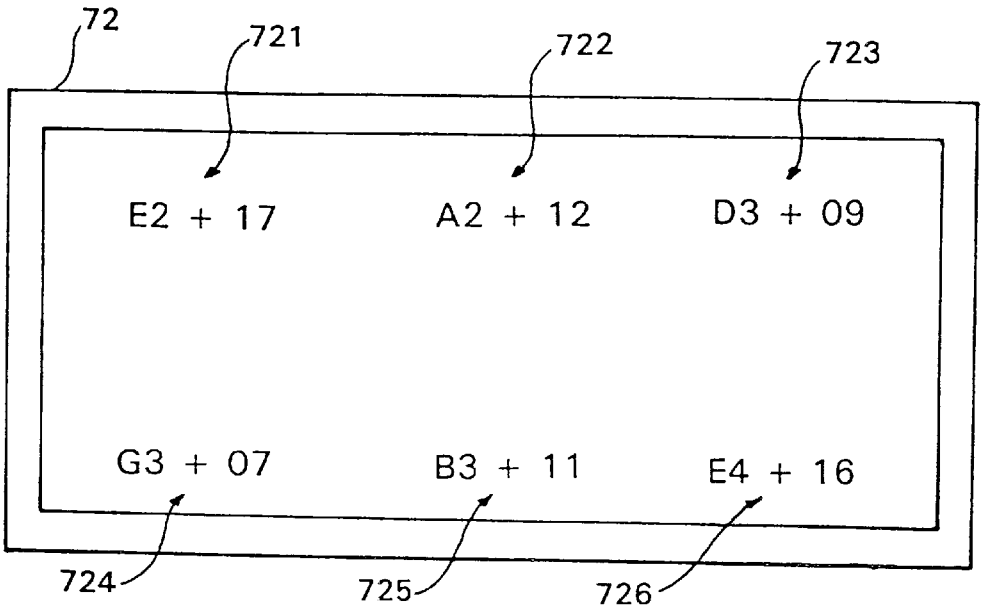
FIG. 5 is a diagram illustrating the frequency display, appearing on the display unit shown in FIG. 4.

FIG. 5 shows the frequency display as it appears on the display unit 72 of FIG. 4. In this display, frequency is shown in terms familiar to an operator, i.e., notes, octaves, and cents, instead of Hertz. The six groups of characters 721–726 indicate the measured frequencies of the six strings. The first two characters in each group, e.g., E2 in group 721, represent the nearest note and the octave. The last three characters in each group, e.g., E2 in group 721, represent the offset in cents of the measured frequency from the note shown in the first two characters of that group. Displaying the octave is particularly useful when changing a string.

Alternatively, numerous other frequency display formats can be used. For example, rather than indicate the note and octave, the display can simply indicate the deviation of the measured frequency from the corresponding target frequency. The magnitude of the deviation can be given in cents or can be generally indicated, for example by the number of lights illuminated. The display can be limited to indicating whether the measured frequency is sharp or flat with appropriate symbols or colored lights. The display can also indicate the measured frequency in Hertz.

The processor of this invention determines the frequency of each tone with an accuracy sufficient for tuning a musical instrument. Since the human ear can generally distinguish a frequency difference of two cents, that is the preferred minimum accuracy of the frequency measurement and display. For discriminating ears, the preferred accuracy is better than one cent.

The display system is especially useful when tuning an instrument in which multiple strings are out of tune. For example, when a broken string is replaced, when a new set of strings is installed, or when the mechanical alignment of the automatic tuning system has shifted, more than one string is affected. In the case of replacing a broken string, as that string is brought into tune, it can be seen if the other strings are coming back to their original tuning or, if not, the magnitude and direction of the errors. With a new set of strings, seeing the magnitude and direction of the adjustment needed for each of the strings simultaneously minimizes the number of tuning iterations required to bring the instrument into tune. Similarly, if the tuning of the instrument shifts due to movement of the tuning pegs or changes in the automatic tuning mechanism, it is strategically beneficial to be able to see the entire extent of the misalignment or mistuning at one time.

In the case of a closed-loop (servo) tuning system, it may be necessary to manually tune each string to align the center of its desired frequency range with the center of its actuator position range, or at least to locate its desired frequency range between the logical or physical limit stops of its actuator.

In the case of an open-loop tuning system, it is necessary to manually tune each string to align its frequency, at least roughly, with a corresponding actuator position. If the manual tuning is only roughly correct, then a new calibration must be performed to generate a calibration function relating frequency and actuator position. If the manual tuning is done precisely enough, it is possible to use the original calibration. With the system described in the aforementioned copending U.S. patent application (attorney docket no. 63-94), an original calibration function can be used without a touch-up if the manual tuning is within two cents of the target frequency and with a touch-up if the manual tuning is within 20 cents of the target frequency.

When manual tuning is complete and the instrument is placed under automatic tuning control, to prevent shifts in tuning due to movement of the tuning pegs, the strings can be clamped above the nut of an instrument to isolate the vibrating portion of each string from movement of its peg.

As will be obvious to those skilled in the art, the display system of this invention and of the automatically tuned instrument in which it is used can be constructed with a wide range of apparatus as described below.

Devices for providing a transducer signal include transducers sensitive to sound waves such as microphones, magnetic or electric field sensing devices coupled to vibrating elements of an instrument, optical sensors coupled to vibrating elements, and transducers sensitive to frequency-related phenomena such as strain gauges measuring tension in strings of stringed instruments. The term transducer is used herein for any device for providing a signal from which a string frequency can be obtained, and is not limited to the examples cited above. The term transducer is used in the singular to refer to one or a plurality of devices coupled to the strings. Depending on the particular transducer, the coupling to the strings can be, for example, mechanical, electrical including electric or magnetic fields, or optical.

Although Schmitt triggers are shown in FIG. 2 for converting an analog signal to a binary signal and for preventing edge slivers in the binary signal, other methods will be obvious to those skilled in the art. Other devices for conditioning a transducer signal for use by a processor include amplifiers, buffers, comparators, filters, and various forms of zero-crossing detectors, time delay circuits, and voltage level shifters. The signal conditioners can be part of the processor.

Frequency measuring techniques include timers measuring the periods of signals, such as digital counters implemented in either hardware or software, or digital counters counting the number of cycles of a signal in a period of time. Other techniques include the use of Fourier transforms or other processing algorithms, analog filters or digital filters implemented in hardware or software, and digital signal processors. The latter techniques are especially useful for separating the component frequencies of complex waveforms such as produced by a single transducer coupled to multiple strings.

Various techniques for interconnecting functional blocks are also available to those skilled in the art. In addition to the usual wired connections are optical, ultrasonic, and radio links which permit remote location of portions of the tuning system.

Display units include display devices such as light emitting diodes (LEDs), fluorescent displays, various other forms of LCDs, and indicator lights as well as appropriate driver circuits.

Many of the previously named devices such as fluorescent, LED and liquid crystal display units, transducers, analog switches, amplifiers, buffers, comparators, filters, Schmitt triggers, delay lines and delay networks, counters, timers, multiplexers, optical couplers, and digital signal processors (DSPs) are available as off-the-shelf solid-state integrated circuits. Also readily available are application notes describing various configurations and applications of these devices to signal handling and processing. These devices and the techniques of using them are familiar to those having ordinary skill in the art of signal processing.

There are also many types of actuators adaptable to tuning an instrument, including electromechanical devices such as stepper motors, servo motors, linear motors, gear motors, leadscrew motors, piezoelectric drivers, shape memory metal motors, and various magnetic devices. Position reference devices for actuators include electrical contacts, optical encoders and flags, potentiometers, and mechanical stops for stepper motors. Many other types of apparatus will be obvious to those skilled in the art of control systems. A preferred embodiment includes the choice of an actuator which holds its position when power is removed; for example, a stepper motor or a gear ratio, leadscrew pitch, lever arm, or ramp with a critical angle such that if the motor produces no torque the tuning does not change. The motors can be connected to the strings by directly attaching a string to a motor shaft, or by various mechanical systems utilizing components such as gears, pulleys, springs and levers. The actuator can change the tension on the string by pulling along the axis of the string or by transverse deflection of the string. Many mechanical actuators for altering string tension have been described in the art. The control system of the present invention can be employed with any actuator. Each string can have more than one actuator attached to it, for example for coarse and fine control of the string frequency.

While the invention has been described above with respect to specific embodiments, it will be understood by those of ordinary skill in the art that various changes in form and details may be made therein without departing from the spirit and scope of the invention which receives definition in the following claims.

We claim:

1. A frequency display system for an automatically tuned stringed instrument, said instrument having a plurality of strings, each string having a manual tuning mechanism connected thereto, each string further having an electric actuator connected thereto, said instrument further having a transducer coupled to said strings, said display system comprising:

a processor, adapted to be coupled to the transducer, having means for receiving a transducer signal from said transducer, means for obtaining the measured frequency of each of said plurality of strings from said transducer signal, and means for generating a display signal from said measured frequencies; and a display unit, coupled to said processor, for receiving said display signal and for simultaneously displaying frequency indicators of at least two of said measured frequencies;

wherein said display signal is updated in response to manual tuning of said strings.

2. The display system of claim 1 wherein said display signal is generated in real time.

3. The display system of claim 2 wherein said display signal is continually updated.

4. The display system of claim 1 wherein said actuators have a preferred range of actuator positions for automatic tuning operation and wherein said display system can be used during manually tuning to adjust the string frequencies so that said actuators operate within said preferred range of actuator positions.

5. The display system of claim 4 wherein said preferred range of actuator positions correspond to limit stops on said actuators.

6. The display system of claim 5 wherein each of said strings has a target range of accessible frequencies and wherein said range of actuator positions provides said target range of accessible frequencies.

7. The display system of claim 1 wherein said processor further comprises control means for generating actuator control signals in accordance with said measured frequencies.

8. The display system of claim 7 wherein said control means utilizes a calibration function.

9. The display system of claim 7 wherein said control means utilizes a closed-loop system.

10. The display system of claim 1 wherein said transducer provides separate transducer signals for each of said strings.

11. The display system of claim 10 wherein said transducer is magnetically coupled to said strings.

12. The display system of claim 10 wherein said transducer is optically coupled to said strings.

13. The display system of claim 10 wherein said means for obtaining the measured frequency utilizes period measurement.

14. The display system of claim 1 wherein said transducer provides a transducer signal representative of the frequencies of at least two of said strings.

15. The display system of claim 14 wherein said means for obtaining the measured frequency utilizes a Fourier transform.

16. The display system of claim 14 wherein said means for obtaining the measured frequency utilizes a plurality of frequency bandpass filters to separate said frequencies of at least two strings.

17. The display system of claim 16 wherein said means for obtaining the measured frequency further utilizes period measurement of the filtered transducer signal.

18. The display system of claim 1 wherein said frequency indicators show the nearest note and cents deviation of each of said measured frequencies.

19. The display system of claim 1 wherein said frequency indicators show the deviation of each of said measured frequencies from corresponding target frequencies.

20. The display system of claim 1 wherein the accuracy of said frequency indicators is sufficient for manual tuning of said instrument.

21. The display system of claim 20 wherein said accuracy is within two cents.

22. The display system of claim 21 wherein said accuracy is within one cent.

23. A method of changing a string on a automatically tuned stringed instrument, said instrument having a plurality of strings, each string having an actuator and a manual tuning mechanism connected thereto, said instrument further having a transducer coupled to said strings and having the display system of claim 1 coupled to said transducer, comprising the steps of:

removing an old string;

attaching a new string to said actuator and to said manual tuning mechanism;

strumming said new string;

observing the frequency indicator of said new string on said display unit;

manually tuning said new string to a target frequency.

24. The method of changing a string of claim 23 wherein a plurality of strings are changed and wherein said plurality of strings are strummed and a plurality of corresponding frequency indicators are observed simultaneously.

25. The method of changing a string of claim 23 wherein said actuator has an actuator position range and said string has a desired frequency range, and wherein said target frequency is selected to locate said desired frequency range within said actuator position range.

26. The method of changing a string of claim 23 wherein said instrument utilizes a calibration function relating frequency and actuator position and wherein said target frequency approximately corresponds, via the calibration function, to the current actuator position of said actuator.

27. A method of manually tuning an automatically tuned stringed instrument, said instrument having a plurality of strings, each string having an actuator and a manual tuning mechanism connected thereto, said instrument further having a transducer coupled to said strings and said instrument further having a display unit, comprising the steps of:

strumming said plurality of strings;

receiving a transducer signal from said transducer;

obtaining the measured frequency of each of said plurality of strings from said transducer signal;

simultaneously displaying, on said display unit, frequency indicators of said measured frequencies; and manually tuning at least one of said strings in accordance with said frequency indicators.

28. The display system of claim 3 wherein said display signal is continually updated as long as said strings are vibrating with sufficient amplitude and wherein, when said amplitude is insufficient, said display signal holds the frequency display of the last sufficient amplitude.

29. The display system of claim 28 wherein, when holding the frequency display of said last sufficient amplitude, said display signal provides an indication that said frequency display is being held.

* * * * *